United States Patent [19]

Johnson, III et al.

[11] 4,177,724

[45] Dec. 11, 1979

[54] STRAP TENSIONING DEVICE

[75] Inventors: Eric A. Johnson, III, Crawfordsville; Melvin E. Moore, Rockville; Tom A. Budd, Crawfordsville, all of Ind.

[73] Assignee: Keystone Consolidated Industries, Inc., Peoria, Ill.

[21] Appl. No.: 912,512

[22] Filed: Jun. 5, 1978

[51] Int. Cl.[2] ..... B65B 13/22

[52] U.S. Cl. ..... 100/26; 100/32

[58] Field of Search ..... 100/26, 29, 30, 32

[56] References Cited

U.S. PATENT DOCUMENTS

| | | | |
|---|---|---|---|
| 3,057,289 | 10/1962 | Luthi | 100/26 |
| 3,146,695 | 9/1964 | van de Bilt | 100/32 X |
| 3,157,109 | 11/1964 | Flanigan | 100/32 X |
| 3,179,038 | 4/1965 | MacKenzie | 100/32 X |
| 3,327,618 | 6/1967 | Cook | 100/32 X |
| 3,667,378 | 6/1972 | van de Bilt | 100/32 X |

FOREIGN PATENT DOCUMENTS

| | | | |
|---|---|---|---|
| 1152662 | 8/1963 | Fed. Rep. of Germany | 100/32 |
| 1176711 | 1/1967 | United Kingdom | 100/26 |

*Primary Examiner*—Billy J. Wilhite

*Attorney, Agent, or Firm*—Allegretti, Newitt, Witcoff & McAndrews

[57] ABSTRACT

In a package strapping machine an improved means for tightening the strap extending from a strap supply about a package to be strapped including feed means, retract means, linearly reciprocating tension means and a secondary gripper in which the tension means is outside of the path of the strap between the feed means and the retract means and in which the tension means reciprocates in a direction approximately normal to the usual path of the strap traveling through the tension means.

4 Claims, 1 Drawing Figure

STRAP TENSIONING DEVICE

BACKGROUND OF THE INVENTION

The present invention is considered an improvement of and a departure from such prior strapping machine devices as for example disclosed in U.S. Pat. No. 3,667,378 to Van de Bilt entitled Wire or Band Strapping Machine. In the Van de Bilt patent is disclosed a device for a strapping machine in which a band is passed about a looped path. A first pair of rollers functions as a feeding means for the band and a second pair of rollers functions as a retraction means for the band. A linearly reciprocating tension device is positioned between the feeding rollers and the retraction rollers. The feeding rollers are located nearer to the closed loop than are the retraction rollers with respect to the direction of movement of the wire or band.

That device, while generally acceptable for the purposes intended, required a rather long stroke by the linearly reciprocating tension gripper. It required a gripper which was adapted to positively grasp the strap and to move the strap in a direction substantially parallel to the direction of the strap travel through the tension gripper. Thus, the strap was taken up only to the same degree that the tension gripper was extended. In other words, if the tension gripper were extended by three inches, then the net strap take-up would be limited to a maximum of three inches. This requires a relatively large amount of room in which the tension gripper cylinder may be reciprocated during the gripping operation. Because of the telescoping cylinder and piston rod arrangement, the total room required to accommodate the tension gripper was multiplied.

SUMMARY OF THE INVENTION

The present invention is directed to an improvement over and departure from the Van de Bilt type device described above. In particular, the present device is directed to a package strapping machine having an improved means for tightening the strap extending from a strap supply about a package to be strapped. The invention includes feed roller means for feeding the strap about a closed loop, means for gripping the lead end of the strap after it has been fed around the closed loop, retract roller means for retracting excess strap from the closed loop after the gripping means has gripped the lead strap end, a linearly reciprocating tensioning device positioned to extend in a direction approximately normal to the usual path of the strap passing through the tension device. The tension device is positioned outside of the path of the strap between the feed and retract means. A secondary gripper means is located between the linearly reciprocating tension device and the strap supply. It is adapted to grip the strap prior to the operation of the linearly reciprocating tension device. In this manner, the linearly reciprocating tension device may extend to place final tension in the strap about the package. The amount of strap take-up by the tension device is substantially greater than the amount of linear extension of the tension gripper thus minimizing the need for extension of the tension device, reducing the room required to accommodate the tension device and decreasing the time which is necessary for a proper tension operation.

Accordingly, it is an object of the present invention to provide a new and improved means for tensioning a strap about a package to be strapped.

It is also an object of the present invention to provide such a strapping device in which the final tensioning means is as small, compact and simple as possible and is capable of executing as minimal a stroke as possible.

It is a further object of the present invention to provide such a device which will be economic and easy to maintain and construct.

BRIEF DESCRIPTION OF THE DRAWING

There follows a brief description of the drawing showing a presently preferred embodiment of the present invention wherein like numerals refer to like elements and wherein.

DETAILED DESCRIPTION OF THE PREFERRED EMBODIMENT

Figure 1:
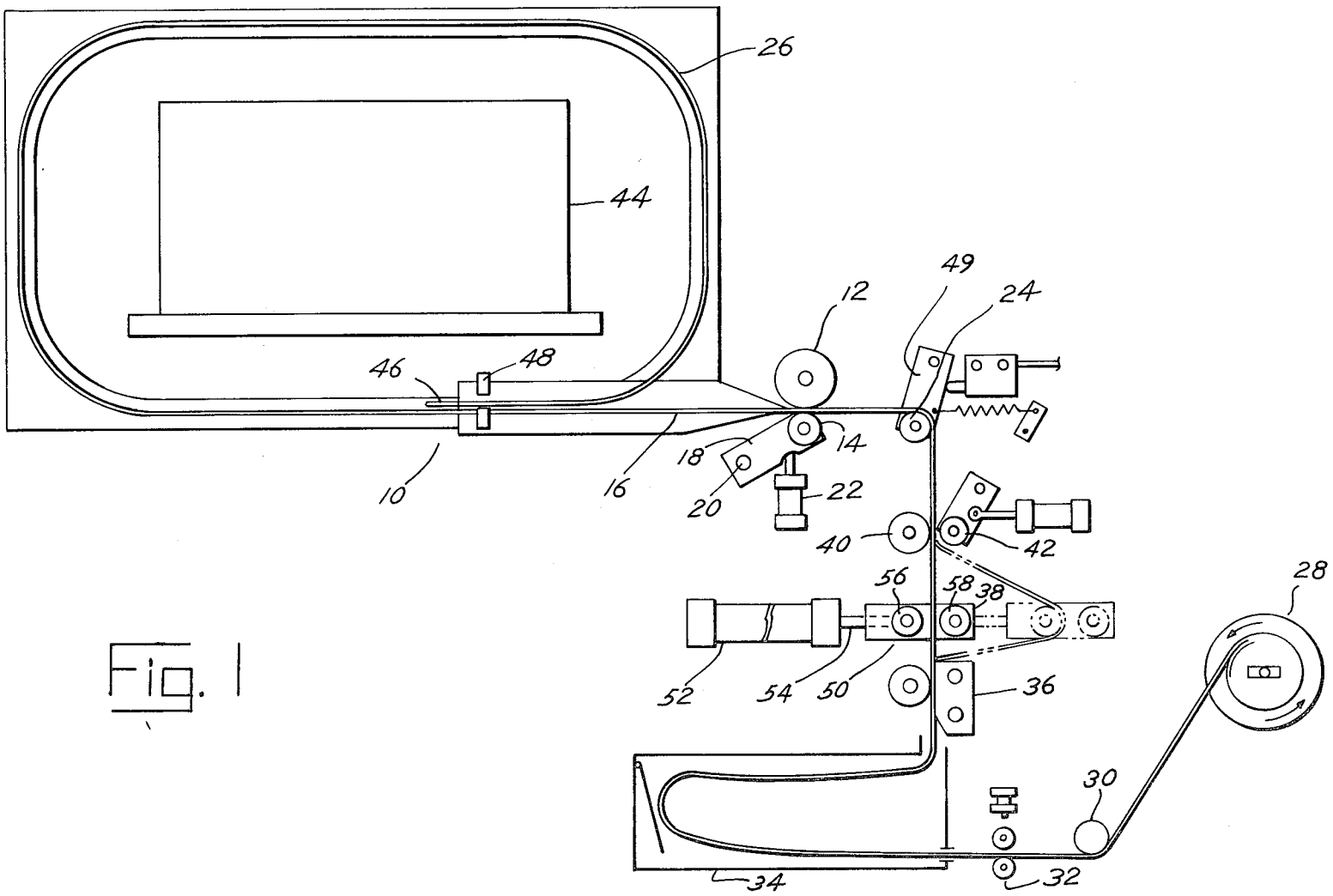
FIG. 1 is a side diagramatic view of the strap tensioning device of this invention.

As shown in FIG. 1, a package strapping machine 10 shown in partial detail includes a pair of feed rollers 12 and 14 which are movable with respect to one another. A strap 16 passes between contactable portions of the feed rollers 12 and 14. Feed roller 14 is connected so as to be translated toward feed roller 12 by means of an arm 18 pivotally connected at pivot-point 20. A power means 22 is provided for operating the arm 18 to move the feed roller 14 toward the feed roller 12.

An idler pulley 24 is provided to guide the strap 16 toward a closed loop path 26. The strap is supplied from a strap supply disc 28 and extends from the disc 28 about a portion of an idler pulley 30 through a magazine supply 32 and into a magazine 34. The magazine supply assembly 32 is provided to maintain the magazine 34 supplied with a sufficient amount of strap 16.

The strap exits through the upper portion of the magazine 34 into a secondary gripper 36. The strap then passes through a linearly reciprocating tension device 38 after which it passes through a pair of retract rollers 40 and 42. The strap 16 is then guided about the idler pulley 24 and through the feed rollers 12 and 14. It is then passed into the closed loop 26 to form a closed loop about a package 44 to be strapped. A lead end 46 of the strap 16 is passed up to an end gripper means 48 for gripping the lead end of the strap after the strap has been fed about the loop 26.

A full sequence of operation during a single package strapping cycle is described as follows. A sufficient amount of strap 16 has already been supplied from the supply 28 into the magazine 34 by means of a magazine supply assembly 32. The feed rollers 12 and 14 are activated to send the strap 16 around the closed path 26 until the lead end 46 of the strap 16 passes at least up to the end gripper 48. The feed rollers 12 and 14 then terminate feeding and the gripper 48 engages to grip the lead portion 46 of the strap 16. Subsequently, the retract rollers engage the strap 16 to pull the strap 16 relatively tightly about the package 44. During this operation the strap 16 is freely returned directly into the magazine 34 through the tension device 38 and secondary gripper 36.

Tension in the strap 16 is sensed by a tension sensing device 49. After a predetermined tension has been achieved by the retract rollers 40 and 42, operation of the retract rollers 40 and 42 is terminated and the secondary gripper 36 is operated to engage the strap 16 so as to prohibit relaxation of the mildly tensioned strap 16 about the package 44. Then the tension device 38 is activated to extend a tension head 50 of device 38 linearly away from a tension cylinder 52. The tension head 50 is connected on a piston rod 54 for linear extension. A pair of rollers 56 and 58 are mounted on head 50 and the strap 16 passes between the rollers 56 and 58. The cylinder 52 is positioned in relation to the path of strap movement so that the linear extension of head 50 is in a direction substantially perpendicular to the path of strap movement.

As shown by the faint lines, when head 50 is extended, the surface of strap 16 travels against inner roller 56. When full necessary extension of head 50 occurs, the amount of strap take-up is somewhere between one and two times the amount of linear extension of head 50 as can be graphically seen. No gripper need be attached to the reciprocating head 50 of the tensioning device 38. This simplifies the moving portion of the assembly from those known in the prior art and eliminates the need for a positive grip or engagement of the strap by the tension device.

While in the foregoing there has been described a presently preferred embodiment of the present invention, it should be understood that this embodiment is merely illustrative of the true spirit and scope of the invention.

What is claimed is:

1. In a package strapping machine an improved means for tightening the strap extending from a strap supply about a package to be strapped, comprising, in combination:

feed roller means for feeding the strap about a closed loop to encircle a package to be strapped, means for gripping the lead end of the strap after it has been fed around the closed loop, retract roller means for retracting excess strap from the closed loop after the gripping means has gripped the lead strap end so as to tighten the strap about the package, a linearly reciprocating tension means positioned outside of the path of the strap between said feed means and said retract means and relatively farther from said closed loop than either the feed means or the retract means in relation to the direction of strap feed, said tension means positioned to extend in a direction approximately normal to the free running strand of strap passing through the tension means; and a secondary gripper means between the linearly reciprocating tension means and the strap supply adapted to grip the strap prior to operation of the linearly reciprocating tension means whereby, when the linearly reciprocating tension means extends to place a final tension in the strap about the package, the amount of strap take-up by the tension means is substantially greater than the linear extension of the tension means thus minimizing the required extension of the tension means and reducing the room necessary within the machine to accommodate the tension means.

2. The invention as set forth in claim 1 wherein the tension means includes a cylinder and a piston rod within the cylinder and a tension head connected to the rod for linear extension with the rod.

3. The combination as set forth in claim 2 wherein the tension head includes a pair of rollers connected thereto and adapted to have the strap pass therebetween.

4. The invention as set forth in claim 1 including a magazine positioned upstream of the secondary gripper in relation to the direction of strap travel to wrap the package whereby when strap is tightened about the package during operation of the retract wheels, it may be readily returned into the magazine.

* * * * *